US006129079A

United States Patent [19]

French et al.

[11] Patent Number: 6,129,079

[45] Date of Patent: Oct. 10, 2000

[54] GAS FIREPLACE WITH ROTATING LOG ASSEMBLY

[75] Inventors: J. Timothy French, Anaheim; Samir E. Barudi, Huntington Beach, both of Calif.

[73] Assignee: Superior Fireplace Company, Fullerton, Calif.

[21] Appl. No.: 09/389,667

[22] Filed: Sep. 2, 1999

Related U.S. Application Data

[60] Provisional application No. 60/113,666, Dec. 1, 1998.

[51] Int. Cl.[7] ..... F24B 1/187

[52] U.S. Cl. ..... 126/502; 126/92 R; 126/512; 431/125

[58] Field of Search ..... 126/512, 502, 126/503, 504, 92 R, 92 AC, 92 A, 500; 431/125, 126; 236/101 D, 101 E, 96, 101 R; 40/428; 392/348

[56] References Cited

U.S. PATENT DOCUMENTS

| | | | |
|---|---|---|---|
| 3,805,762 | 4/1974 | Nelson | 126/125 |
| 4,838,781 | 6/1989 | Fischer | 431/125 |

FOREIGN PATENT DOCUMENTS

| | | | |
|---|---|---|---|
| 373419 | 5/1932 | United Kingdom | 126/92 R |

*Primary Examiner*—James C. Yeung
*Attorney, Agent, or Firm*—Christie, Parker & Hale, LLP

[57] ABSTRACT

An artificial log is provided for use in a gas fireplace combustion chamber. A portion of the log outer surface has a charred appearance. When the fireplace is turned on and the log is heated, the log rotates to bring the charred surface in view from an open end of the fireplace combustion chamber so as to provide the appearance of a real wood log being burned. When the fireplace is turned off, the log rotates back to a position hiding the charred surface from view so as to have the appearance of a brand new log.

18 Claims, 4 Drawing Sheets

GAS FIREPLACE WITH ROTATING LOG ASSEMBLY

CROSS-RELATED APPLICATIONS

This application is based upon and claims priority on Provisional Application No. 60/113,666 having a filing date of Dec. 1, 1998.

BACKGROUND OF THE INVENTION

The present invention relates to a log assembly for use in gas fireplaces, and specifically to a log assembly having at least one artificial log that has the appearance of a burning log when the fireplace is on and the appearance of a new unburned log when the fireplace is off.

Gas fireplaces are common place in many homes today. Typically these fireplaces have at least one burner which has a gas inlet port and multiple outlet ports. Gas is fed through the inlet port and exits through the outlet ports where it is ignited producing flames.

Positioned generally over and around the burner are artificial logs that are fire resistant. These logs are typically molded from a ceramic fiber composition. However, they may also be made from other non-combustible materials. Some of these logs glow when they are exposed to the hot flames. Other artificial logs are painted using various paints and pigments to create a burning appearance.

The problem with these artificial logs is that they are stagnant in their appearance. For example, if a log is painted to have a burning appearance, that log would be have the burning appearance even when the flames are turned off. Thus, even when the fireplace is off, the logs have the appearance as though they were burned. On the other hand, if the logs are not painted they would have the appearance as though they were not burning even when surrounded by flames.

Some artificial logs glow when exposed to flames. However, they do not provide the burned wood appearance that would be expected from wood exposed to flames. Other artificial logs have a charred appearing surface. The charred appearing surface consists of multiple protrusions or non-uniformities. When exposed to flames the surface of the log between the protrusions glows providing the appearance of wood having a charred surface with the underneath still burning. These artificial logs have the burned appearance even when the fireplace is off.

As such, there is a need for a log assembly for use in a gas fireplace consisting of a log which has the appearance of a charred burning log when the fireplace is on and has the appearance of a brand new log ready to be burned when the fireplace is off.

SUMMARY OF THE INVENTION

A log assembly is provided for use in a gas fireplace. The log assembly can consist of one or multiple artificial logs positioned proximate to the burner in the combustion chamber of a gas fireplace or other gas burning appliance which has a combustion chamber viewable from a location external to the appliance. For convenience the term "fireplace" as used herein refers to fireplaces as well as to other gas burning appliances which have a combustion chamber viewable from a location external to the appliance.

At least one of the logs is a rotating log that can rotate between two positions. A portion of the rotating log outer surface has a charred appearance. The charred surface typically consists of protrusions. When the fireplace is on, the rotating log rotates bringing the charred portion of the log in view. When the fireplace is turned off, the rotating log rotates to a position hiding the charred portion from view.

The log is preferably molded from a ceramic fiber composition. As the log is heated, the surface of the log between the protrusions will glow providing the appearance of burning wood having a charred surface.

A rod is fitted longitudinally through the rotating log. In one embodiment, the rod extends beyond the ends of the log and is mounted on two supports one on either end of the log. The rod supports are typically mounted on the fireplace floor. Sometimes they may even be mounted on the burner. A motor is used to rotate the log based on a temperature measured at the log or near the log. Typically a heat sensor is used to sense the temperature at or near the log. The sensor feeds the temperature information to a controller which in turn controls the motor.

In an alternate embodiment, the rod ends do not protrude beyond the ends of the log. With this embodiment a slot is formed near each end of the log providing access from the log outer surface to the to rod for accommodating the rod supports. One of the slots or a separate slot is formed wide enough to accommodate the motor.

In yet further embodiments, instead of a motor, a shape memory alloy strip or a bimetal strip is used. With these embodiments, the shape memory alloy or bimetal strip is connected at one end to the rod. The strip is then coiled around the rod. The other end of the stip is connected to a support. The strip with support assembly is used in lieu of the motor. Moreover, the strip and support assembly may be used in lieu of a rod support. In such case one end of the strip is connected to the combustion chamber of the fireplace.

When the fireplace is off, the log is positioned such that the charred surface is not in view from the front open end of the fireplace. In the embodiments incorporating a motor, when the fireplace is turned on and the log or its surrounding environment heats up to a certain temperature, the motor controlled by the controller begins to turn the rod, and thus the log, bringing the charred surface in view. As the temperature is further increased, the motor further rotates the log until the charred surface is in full view and preferably positioned to be at an upper portion of the log.

In the embodiments where a shape memory alloy is used, the shape memory alloy which typically contracts when heated attempts to further coil around the rod when exposed to heat and thereby causes the rotation of the log bringing the charred surface in view. As the shape memory alloy is further heated it further rotates the log bringing the charred surface in full view.

In the embodiments where a bimetal is used, the bimetal can be tailored to coil and uncoil as a function of temperature such that it rotates the log to bring the charred surface of the log in view when heated. With all of the embodiments, the log preferably rotates slowly over time bringing a bigger portion of the charred surface in view and providing the appearance that more wood has burned over time.

When the fireplace is turned off and the wood cools off, the motor, shape memory alloy or bimetal cause the log to rotate in a reverse direction so as to place the charred surface out of view from the front open end of the fireplace, thus providing the appearance of a new wood log ready to be burned.

DETAILED DESCRIPTION OF THE INVENTION

The present invention is directed to a log assembly for use in gas fireplaces. The assembly consists of one or a plurality of artificial logs. For illustrative purposes, however, the present invention is described herein in relation to an assembly consisting of a single artificial log.

Figure 1A:
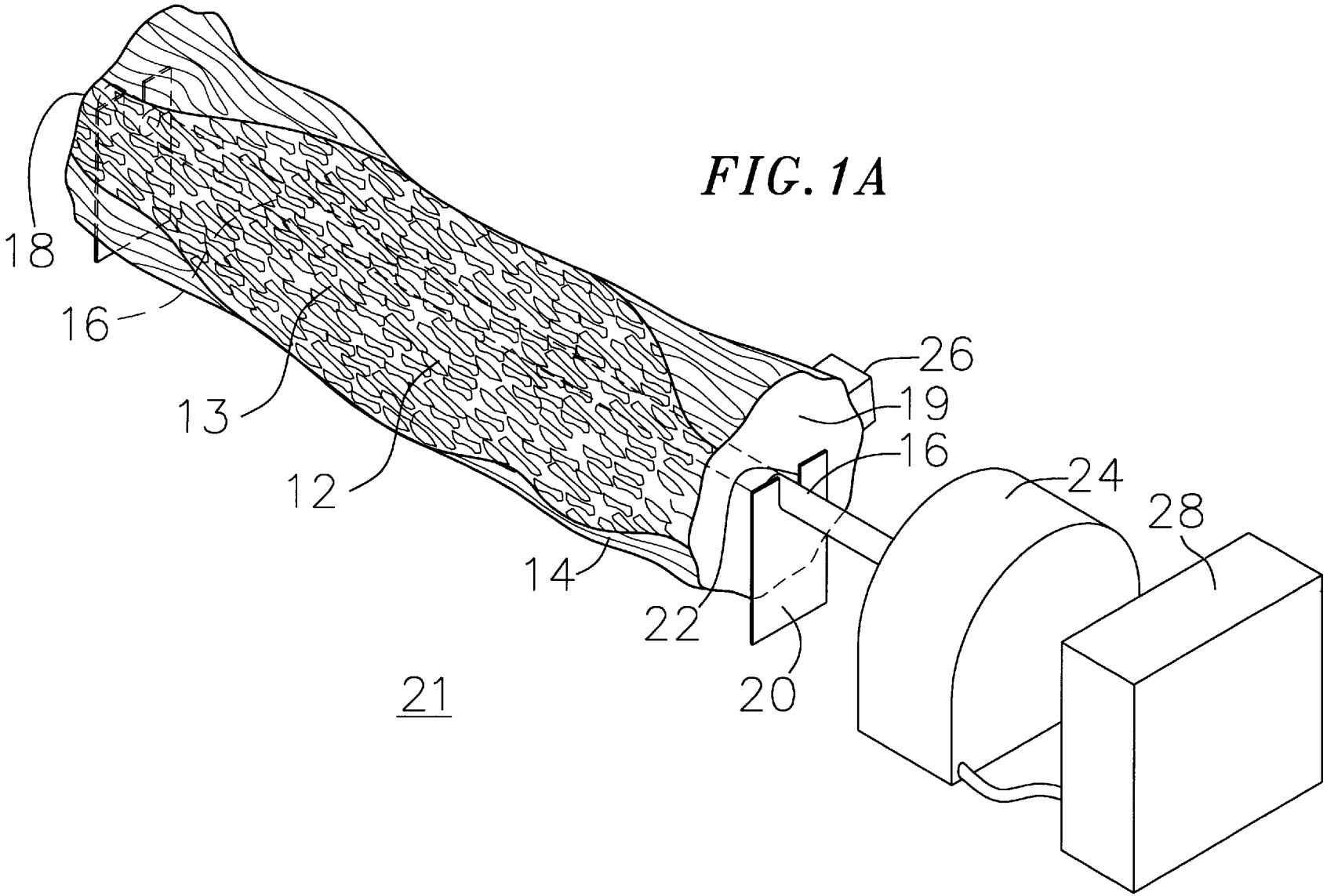
FIG. 1A is a perspective view of an artificial log assembly including an artificial log having a charred appearing outer portion which is rotated by a motor to a maximum rotating position.

The artificial log 10 is preferably molded from a ceramic fiber composition (FIG. 1A). However, the log may be formed from other non-combustible materials. A portion 12 of the artificial log, typically spanning about 90° around its outer surface and about half its length, is formed to have a charred surface appearance. This surface typically consists of multiple protrusions 13. The "charred" portion of the log may be made to span a larger or smaller portion of the log, both circumferentially and longitudinally. The charred portion may be located in different areas along the log. Alternatively, multiple charred portions may be located on the log. However, circumferentially, the charred portion or portions should be limited preferably to an area no more than 180° around the log outer surface. When heated by exposure to flames, the surface 14 between the protrusions glows, providing the appearance of burning wood having a charred surface.

A rod 16 is preferably fitted longitudinally within the log. The rod preferably should also be fitted as close as possible, and if possible coincident to the longitudinal central axis of the log. In a first embodiment, the rod extends beyond each end 18, 19 of the log. Each of the protruding ends of the rod is mounted on an end of a support 20. Typically the rods ends are fitted within an opening or a notch 22 on the supports. The rod is able to rotate along its longitudinal axis while on the supports. Typically, the supports are mounted or extend from the floor 21 of the fireplace combustion chamber 50. In some embodiments, the supports may be mounted on the burner itself (not shown).

A motor 24 is coupled to an end of the rod. The motor rotates the rod and thereby the log. The motor itself may be supported on the burner or on the combustion chamber floor. The motor is preferably an electrical motor. A heat sensor 26 is located near or on the log. The sensor senses the temperature of the log or near the log and feeds this information to a controller 28. In response, the controller controls the operation of the motor. The sensor may be integral with the motor or the controller. In fact, the motor, controller and sensor may be integral, i.e., provided in a single package. Moreover, more than one sensor may be used. When a signal of a predetermined high temperature is received by the controller, it causes the motor to rotate a predetermined distance in a predetermined direction (e.g., clockwise or counter-clockwise). When the signal of a predetermined low temperature is received by the controller, the controller causes the motor to rotate the log a similar distance in the opposite direction. The controller may be programmed to cause the motor to turn the rod and log incrementally based on specific temperatures until the log reaches a specific position. Moreover, the controller can be programmed to gradually rotate the log the predetermined distance in a predetermined direction once the sensed temperature reaches a predetermined value.

Figure 4:
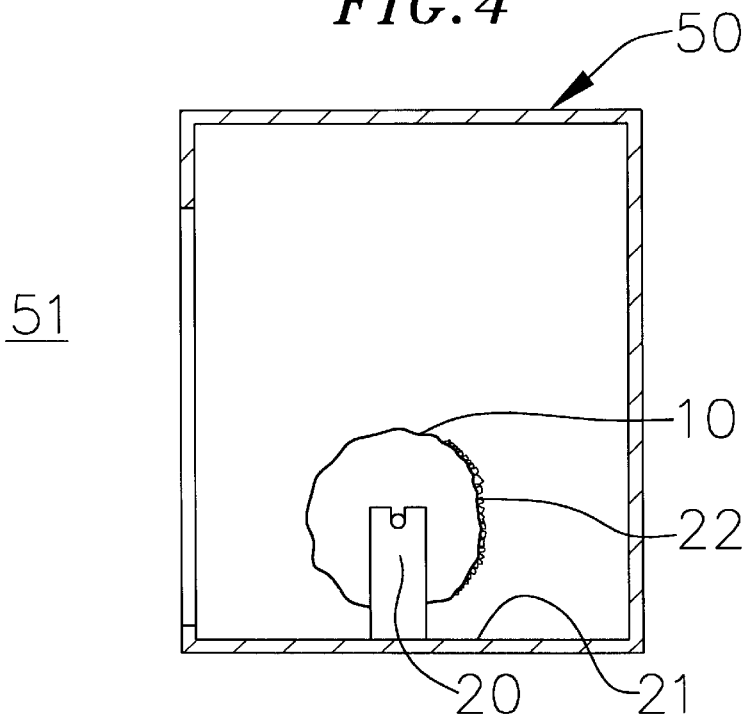
FIG. 4 is a side view of a gas fireplace combustion chamber having a rotating log assembly.

When the log is mounted on the supports, it is mounted such that its charred surface 12 is not visible when viewing the fireplace combustion chamber 50 from its open front end 52 (FIG. 4). When the fireplace is turned on, the flames heat the log. When the temperature at or near the log reaches a predetermined temperature, the motor starts rotating the log bringing the charred surface of the log in view from the fireplace front open end. As discussed above, the rotation can be gradual, incremental or rapid. Due to the heat, the surface of the log between the protrusions forming the charred surface begins to glow providing the appearance that the outer surface of the log has burned while providing the appearance that the inner portion of the log is still burning much like the appearance of real burning wood logs. When the fireplace is turned off and the temperature at, or surrounding, the log is reduced below a predetermined low temperature, the motor rotates the log back to its original position hiding the charred surface from view. Again, the rotation of the log can be gradual, incremental or rapid. The log now looks as though it is a brand new log ready to be burned again.

Figure 1B:
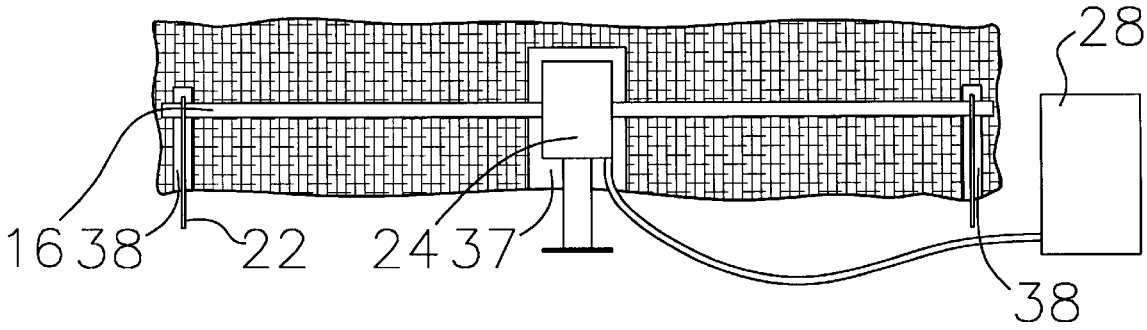
FIG. 1B is a cross-sectional view of an artificial log assembly including an artificial log a motor for rotating the log embedded in the log.

In an alternate embodiment, one or both of the rod ends do not extend beyond the log (FIG. 1B). With this embodiment, a slot 38 is formed near each end of the log providing access from the outer surface of the log to the rod for accommodating the supports 20. One of the slots, or a separate slot 37, may also be formed to concealingly accommodate a motor 24 coupled to the rod as shown in FIG. 1B.

In another embodiment, instead of a motor, a shape memory alloy member 32 is used to rotate the rod (FIGS. 2A, 2B, 2C, 3A, 3B, and 3C). Preferably a strip of the shape memory alloy is used. The strip is attached at one end to the rod 16 and is then coiled around the rod. The other end of the strip is attached to a support member 34 which may be mounted on the fireplace combustion chamber floor 21 or on the burner (not shown). The shape memory alloy may be used in lieu of the motor and may even serve as the rod support. When used as a rod support, one end of the strip is mounted in the combustion chamber floor or the burner.

Figure 2A:
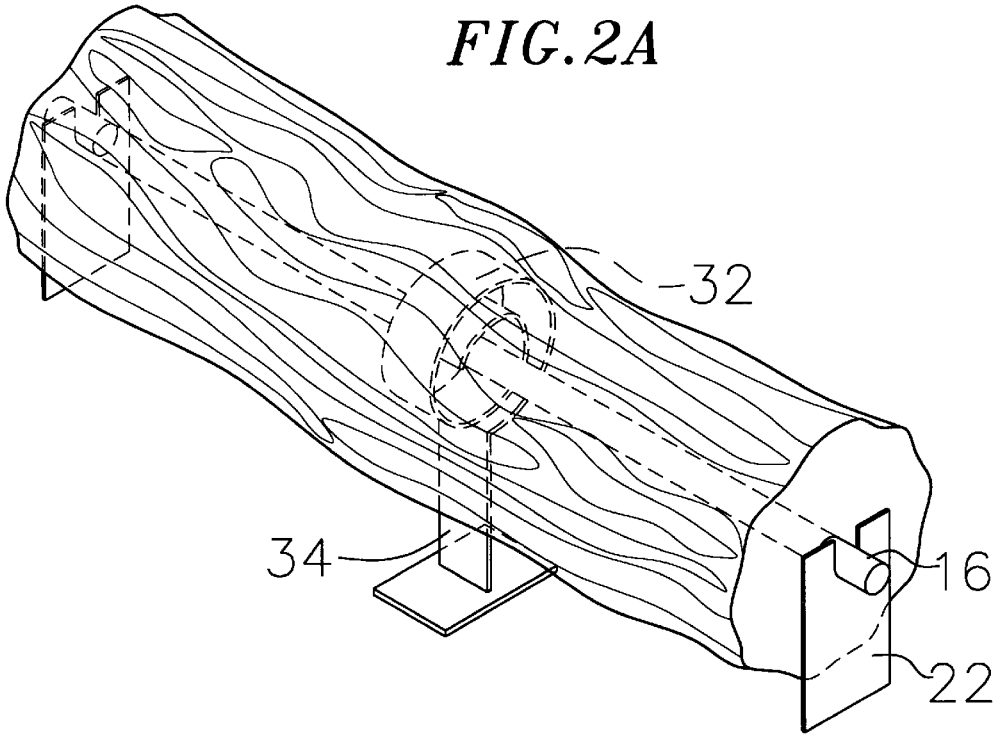
FIG. 2A is a perspective view of an artificial log assembly including an artificial log having a charred appearing outer surface portion which is not in view, which is rotated when heated or being cooled by a shape memory alloy or a bimetal.
Figure 2B:
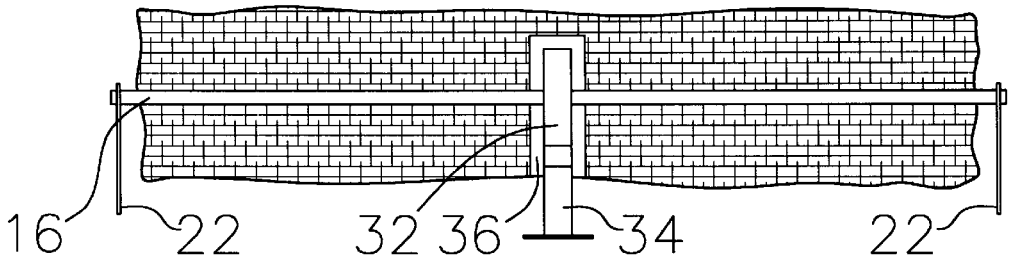
FIGS. 2B and 2C are cross-sectional views of different embodiments of the artificial log assembly shown in FIG. 2A.
Figure 2C:
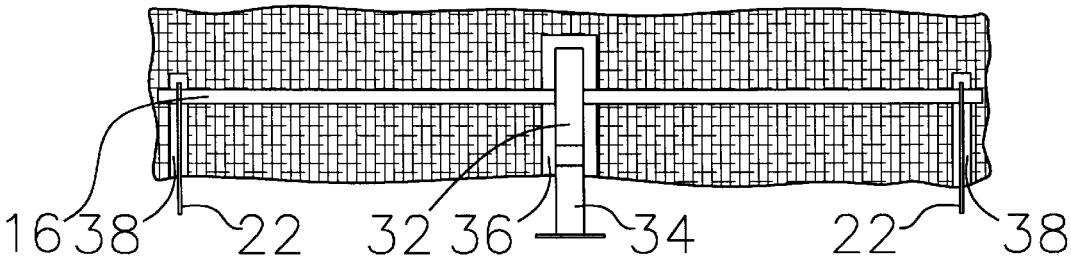

For example, in one embodiment, the strip may be connected to the rod at a location between the two rod support members 22 as shown in FIGS. 2A, 2B and 2C. In a further embodiment, the supports 22 may be positioned within the log as shown in FIG. 2C. The supports access the rod through slots 38 formed on the log body. With this embodiment, the rod ends do not have to extend beyond the log.

Figure 3A:
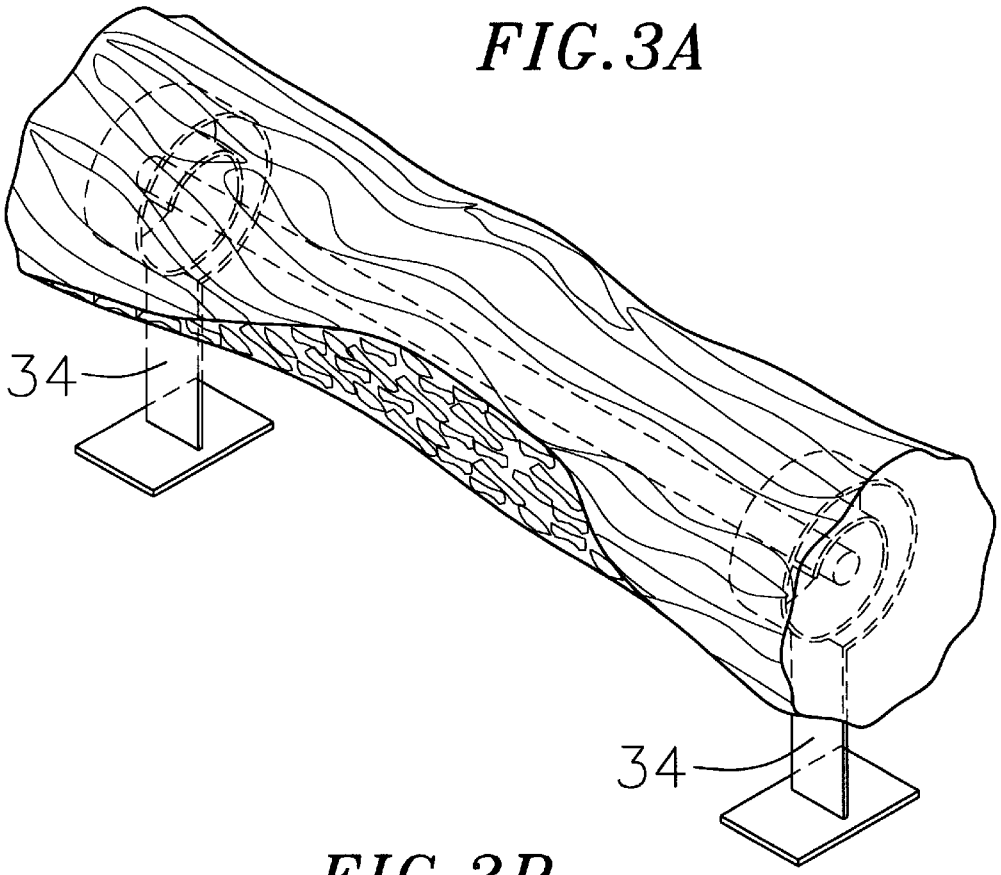
FIG. 3A is an artificial log assembly including an artificial log having a charred appearing outer surface portion which is partially in view. The log is caused to rotate when heated or when cooled by two shape memory alloy or bimetal strips.
Figure 3B:
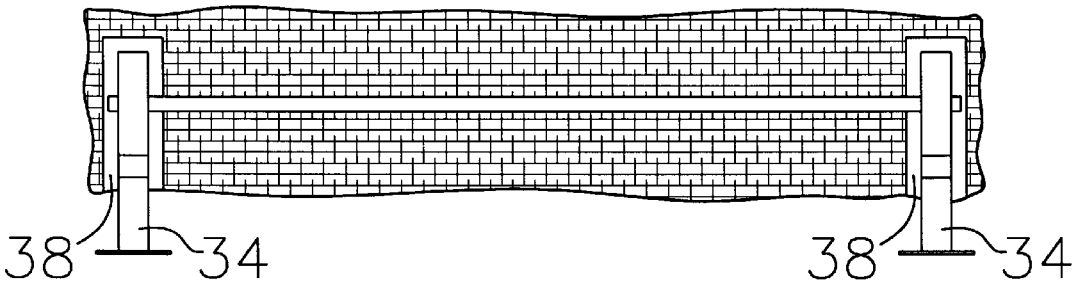
FIGS. 3B and 3C are cross-sectional views of different embodiments of the artificial log assembly shown in FIG. 3A.
Figure 3C:
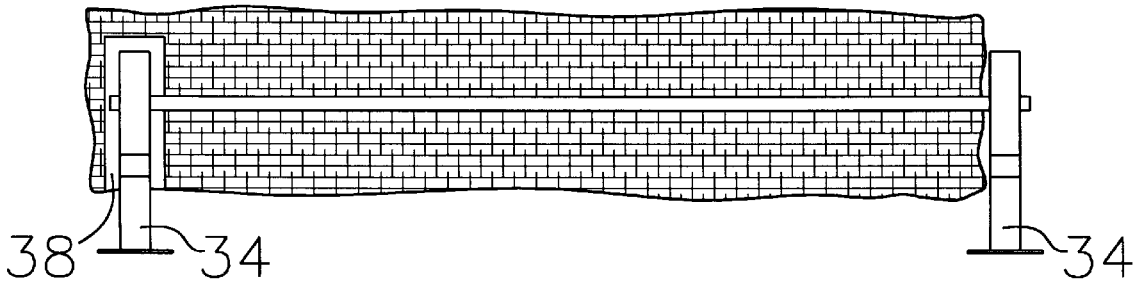

In an alternate embodiment, the shape memory alloy strip may be connected to the rod portion extending beyond a log end as shown in FIG. 3C. In another embodiment, a slot 38 provides access from the outer surface of the log to the rod within the log allowing for the connection with the shape memory alloy strip. One or both of the rod supports 22 may be replaced with supports supporting shape memory alloy strips which are connected to the rod ends as shown in FIGS. 3A, 3B and 3C. The embodiments in which the rod and thus, the log is supported at locations within the log body are preferred because the rod and the shape memory alloy supports are hidden from view.

As the fireplace is turned on, the flames heat the log and thereby heat the shape memory strip which in response coils and thereby rotates the log bringing the charred surface of the log into view. As the temperature is increased, the log is further rotated. When the fireplace is turned off and the shape memory alloy cools down, the shape memory alloy uncoils causing the log to rotate back to a position putting the charred surface out of view. These rotations tend to be gradual.

In an alternate embodiment, the shape memory alloy may uncoil when heated and coil when cooled. With this embodiment, the log is positioned such that the charred surface is out of view from the front open end of the fireplace when the shape memory alloy is coiled.

In yet another embodiment, a bimetal is used instead of a shape memory alloy. Thus, any of the shape memory alloy strips depicted in FIGS. 2A, 2B, 2C, 3A, 3B and 3C may be replaced with a bimetal strip. A bimetal, as the name implies, is a material consisting of two metals such as two metal strips abutted against each other. The two metals have different coefficients of thermal expansion. As such, when the bimetal is exposed to heat one metal attempts to expand more than the other causing the bimetal to curve. Conversely, when cooled, one of the metal contracts more than the other causing the bimetal to curve an opposite direction. In this regard, the bimetal can be made to coil or uncoil when heated or cooled.

With all of these embodiments, the log may be controlled to gradually rotate when heated such that the amount of the charred section being exposed gradually increases over time. For example, the log can rotate from a position as shown in FIG. 2A when to fireplace is off to the position shown in FIG. 3A after the fireplace is turned on and finally to a position as shown in FIG. 1A. This gradual rotation will provide the appearance that a bigger section of the log has burned over time. Moreover, when the fireplace, i.e., the flames are turned off, the log may be controlled to gradually return to its initial position thus initially providing the appearance of a burned log sitting in a fireplace after the fireplace has been turned off. Of course, the log may be controlled to immediately return the its initial position so a to provide the appearance of a new log ready for burning. In the embodiment wherein a motor and controller are used to rotate the log, the controller can be programmed to control the rotation rate and rotation distance of the log. In the embodiments where a shape memory alloy or bimetal is used to rotate the log, the rotation rate and rotation distance of the log will be a function of the type and size of the shape memory alloy or bimetal used.

In further embodiments multiple rotating log assemblies may be incorporated in a fireplace combustion chamber. In such embodiments if motors are used to rotate the logs a single temperature sensor and/or a single controller may be used to control the motors.

What is claimed is:

1. A rotating fireplace log assembly for use in gas operated fireplace having a combustion chamber and comprising:

a log body; and a shape memory alloy member for coupling to the fireplace combustion chamber, the shape memory alloy coupled the log body wherein the shape memory alloy member changes shape due to changes in heat and wherein as the shape memory alloy member changes shape it causes the log to rotate.

2. A rotating log assembly as recited in claim 1 further comprising a support for coupling to the fireplace combustion chamber, wherein, the shape memory alloy is coupled to the support member and the log body.

3. A rotating log assembly as recited in claim 2 further comprising a rod running longitudinally through the log body, wherein the shape memory alloy is a coiled shape memory alloy strip having a first end attached to the support and a second end attached to the rod, wherein the shape memory alloy coils and uncoils as its temperature changes.

4. A rotating log assembly as recited in claim 2 further comprising:

a rod running longitudinally through the log body wherein the shape memory alloy is coupled to the rod and the support member; and a second support member coupled to the rod.

5. A rotating log assembly as recited in claim 4 further comprising a second shape memory alloy strip coiled around the rod, wherein one end of the second coiled strip is attached to the rod and the other end is attached to the second support member.

6. A rotating log assembly as recited in claim 1 wherein the log outer surface comprises a charred appearing section, wherein when the log assembly is placed in a gas fireplace combustion chamber and the log assembly is exposed to heat, the shape memory alloy causes the log to rotate bringing the charred appearing section in view when viewing the log from an open end of a fireplace combustion chamber and wherein as the log assembly cools, the shape memory alloy causes the log to rotate so as to place the charred appearing section out of view when viewing from the open end of the fireplace combustion chamber.

7. A rotating fireplace log assembly for use in gas operated fireplace having a combustion chamber and comprising:

a log body; and a bimetal member for coupling to the fireplace combustion chamber, the bimetal member coupled to the log body wherein the bimetal member changes shape due to changes in heat and wherein as the bimetal member changes shape it causes the log to rotate.

8. A rotating log assembly as recited in claim 7 further comprising a support member for coupling to the fireplace combustion chamber, wherein the bimetal member is coupled to the support member and the log body.

9. A rotating log assembly as recited in claim 8 further comprising a rod running longitudinally through the log body, wherein the bimetal is a coiled bimetal strip having a first end attached to the support and a second end attached to the rod, wherein the bimetal coils and uncoils as its temperature changes.

10. A rotating log assembly as recited in claim 8 further comprising:

a rod running longitudinally through the log body wherein the bimetal is coupled to the rod and the support member; and a second support member coupled to the rod.

11. A rotating log assembly as recited in claim 10 further comprising a second bimetal strip coiled around the rod, wherein one end of the second coiled strip is attached to the rod and the other end is attached to the second support member.

12. A rotating log assembly as recited in claim 7 wherein the log outer surface comprises a charred appearing section, wherein when the log assembly is placed in a fireplace combustion chamber and the log assembly is exposed to heat the bimetal causes the log to rotate bringing the charred appearing section in view when viewing the log from a front open end of a fireplace combustion chamber and wherein as the log assembly cools, the bimetal causes the log to rotate so as to place the charred appearing section out of view when viewing from the open end of the fireplace combustion chamber.

13. A rotating fireplace log assembly having a combustion chamber and comprising:

a log; and a motor coupled to the log for rotating the log as a function of temperature, wherein the log outer surface comprises a charred appearing section wherein when the log is placed within a fireplace combustion chamber and wherein when the temperature at a predetermined location reaches a predetermined first temperature the motor rotates the log bringing the charred appearing section in view when viewing from a front end of the fireplace combustion chamber and wherein when the temperature at a predetermined location cools down to a second predetermined level the motor rotates the log to hide the charred appearing section from view when viewing from the open end of the fireplace combustion chamber.

14. A method for providing a realistic wood burning log appearance in a gas operated fireplace comprising the steps of:

providing a gas log in the fireplace having a charred appearing section; and rotating the log from a first position toward a second position to display the charred appearing section when the fireplace is on and rotating the log toward the first position when the fireplace is off.

15. A method as recited in claim 14 wherein the step of rotating comprises the steps of:

sensing the temperature of the log;

rotating the log toward the second position when the temperature of the log reaches a first predetermined level and rotating the log toward the first position when the temperature of the log cools down to a second predetermined level.

16. A method as recited in claim 15 wherein the step of rotating comprises the steps of rotating the log in one direction toward the first position and rotating the log in an opposite direction toward the second position.

17. A method as recited in claim 15 wherein the step of rotating comprises the steps of rotating the log in the same direction for reaching the first and second positions.

18. A method as recited in claim 15 rotating the log to a position intermediate between the first and second position when the temperature sensed is at a predetermined level intermediate between the first and second temperature levels.

* * * * *